US007416382B2

(12) United States Patent
Guemmer

(10) Patent No.: US 7,416,382 B2
(45) Date of Patent: Aug. 26, 2008

(54) TURBOMACHINE WITH VARIABLE STATOR

(75) Inventor: Volker Guemmer, Blankenfelde-Mahlow (DE)

(73) Assignee: Rolls-Royce Deutschland Ltd & Co KG, Blankenfelde-Mahlow (DE)

( * ) Notice: Subject to any disclaimer, the term of this patent is extended or adjusted under 35 U.S.C. 154(b) by 0 days.

(21) Appl. No.: 11/640,404

(22) Filed: Dec. 18, 2006

(65) Prior Publication Data

US 2007/0140837 A1 Jun. 21, 2007

(30) Foreign Application Priority Data

Dec. 19, 2005 (DE) ..... 10 2005 060 699

(51) Int. Cl.
*F01D 17/16* (2006.01)

(52) U.S. Cl. ..... 415/160; 416/DIG. 2

(58) Field of Classification Search ..... 415/160, 415/163–165, 199.5; 416/223 R, 243, DIG. 2
See application file for complete search history.

(56) References Cited

U.S. PATENT DOCUMENTS

| | | | | |
|---|---|---|---|---|
| 4,231,703 | A * | 11/1980 | Weiler | 415/159 |
| 5,312,230 | A | 5/1994 | Oda | |
| 5,492,446 | A * | 2/1996 | Hawkins et al. | 415/160 |
| 6,129,528 | A * | 10/2000 | Bradbury et al. | 417/423.1 |

FOREIGN PATENT DOCUMENTS

| | | |
|---|---|---|
| CA | 2324950 | 9/1999 |
| CA | 2324951 | 9/1999 |
| DE | 42 43 052 B4 | 10/2004 |
| DE | 698 20 853 T2 | 11/2004 |
| EP | 1 508 669 A1 | 2/2005 |

* cited by examiner

*Primary Examiner*—Ninh H Nguyen
(74) *Attorney, Agent, or Firm*—Timothy J. Klima

(57) ABSTRACT

A variable stator of a turbomachine with a profile skeleton line extending along a meridional flow line, with the stator being radially divided into at least three zones (Z0, Z1, Z2) and with the respective radial inner and the radial outer profile skeleton line of each zone (Z0, Z1, Z2) being designed such that it satisfies the following equations:

$$\alpha^* = \frac{\alpha_1 - \alpha_P}{\alpha_1 - \alpha_2}$$

$$S^* = \frac{S_P}{S}$$

where:

P is any point of the profile skeleton line, $\alpha_1$ is the angle of inclination at the stator leading edge, $\alpha_2$ is the angle of inclination at the stator trailing edge, $\alpha^*$ is the dimensionless, specific angle of the total curvature, $S^*$ is the dimensionless, specific extension, $\alpha_P$ is the angle of the tangent at any point P of the profile skeleton line to the central meridional flow line, $s_P$ is the extension of the profile skeleton line at any point P, and S is the total extension of the profile skeleton line.

10 Claims, 12 Drawing Sheets

Variable stator (borne in casing and hub) in accordance with the present invention

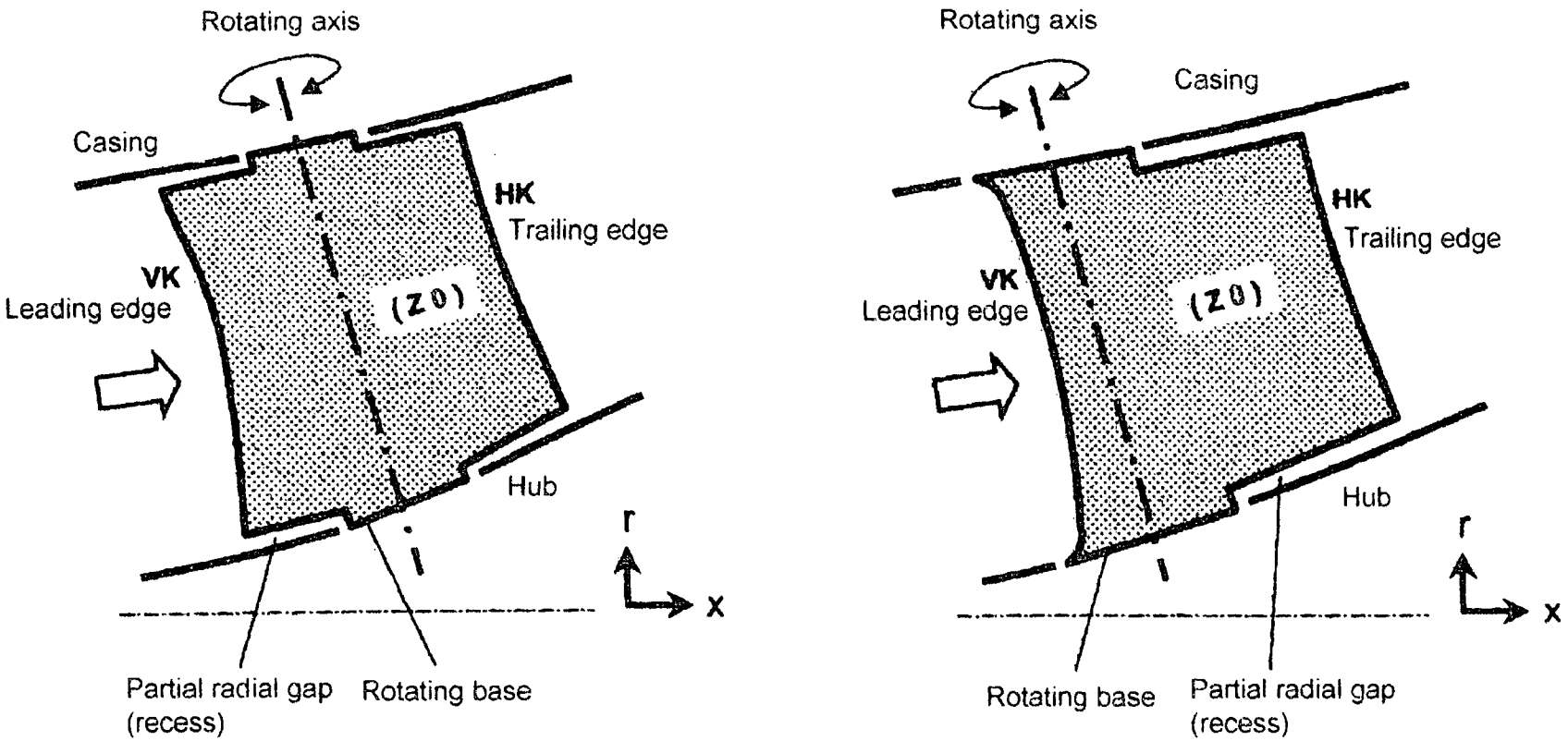
Fig. 1: Schematic representation of variable stators according to the state of the art

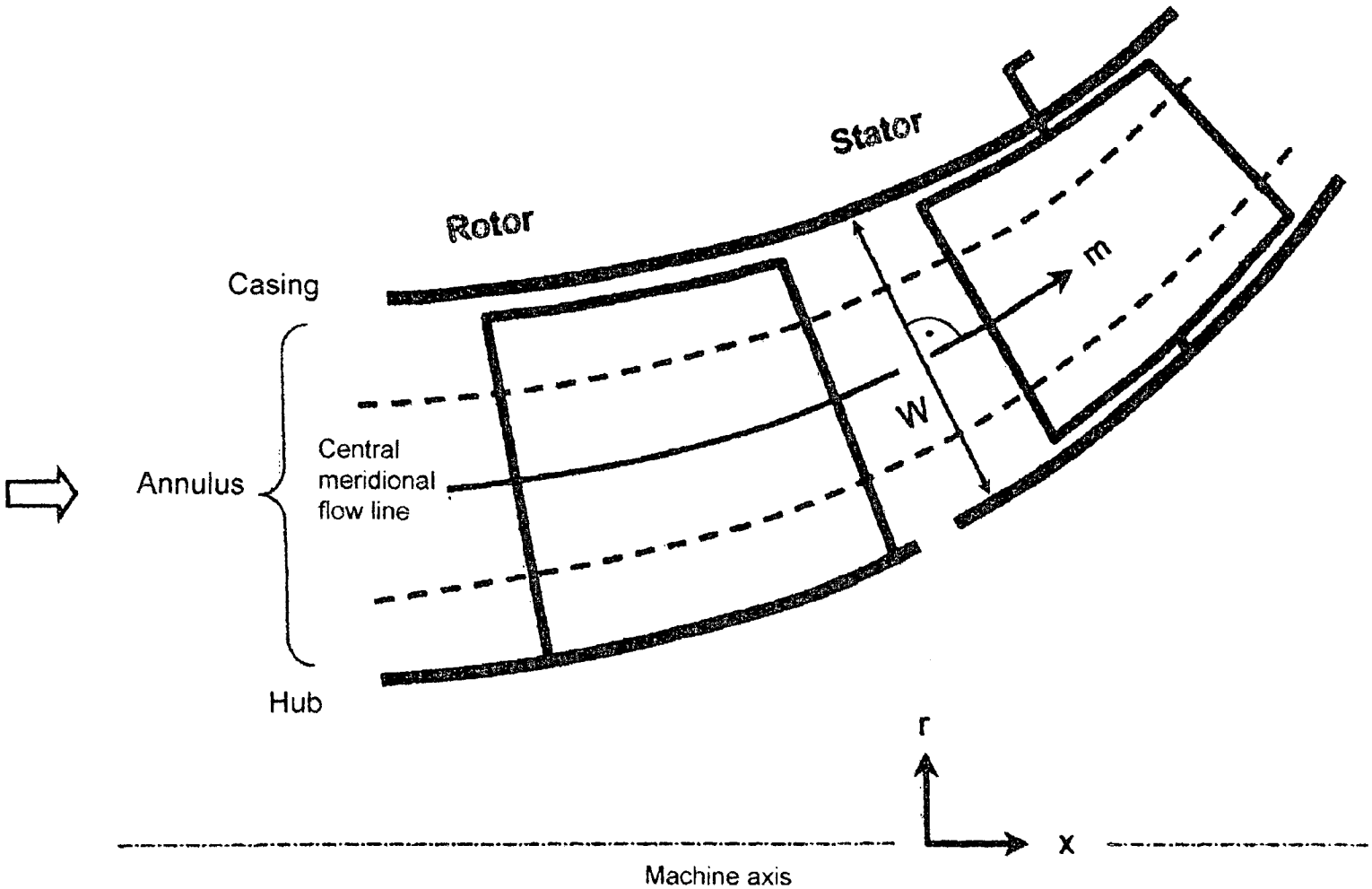
Fig. 2: Definition of meridional flow lines and flow line profile sections

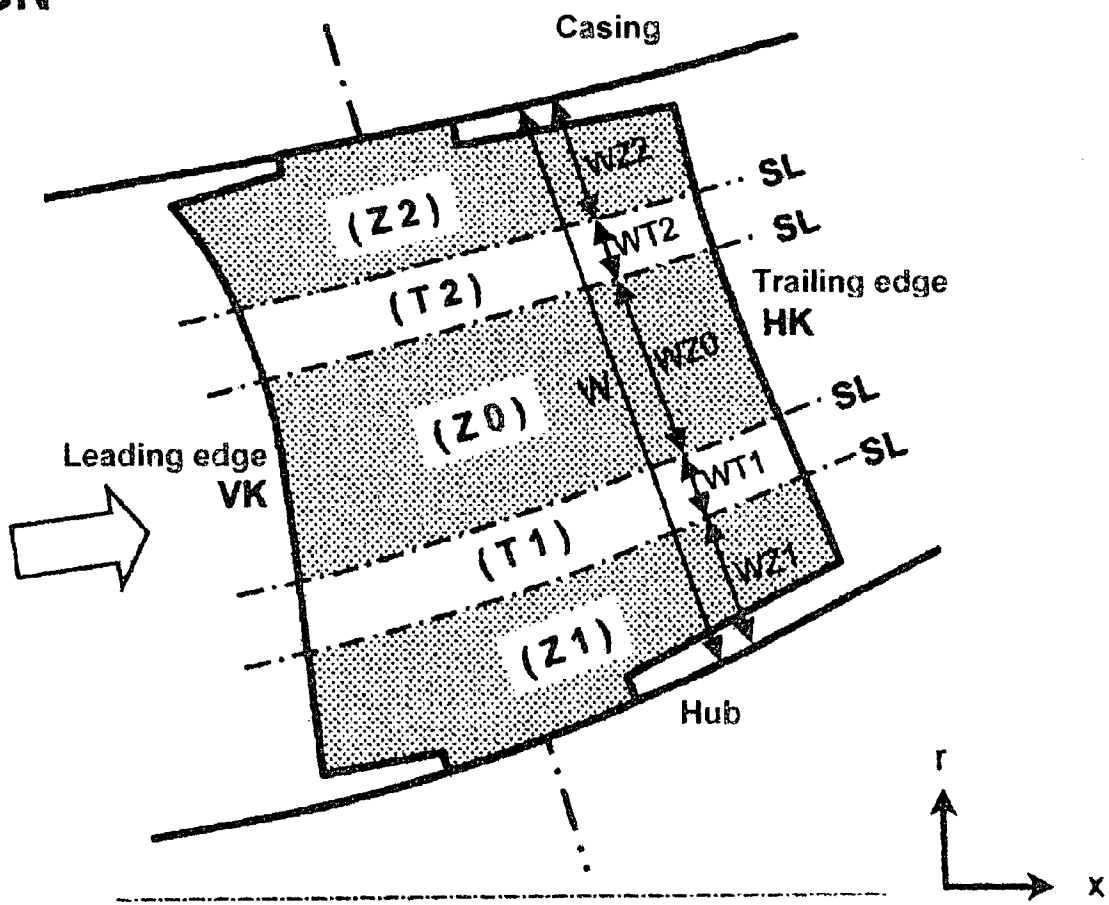
Fig. 3a: Variable stator (borne in casing and hub) in accordance with the present invention

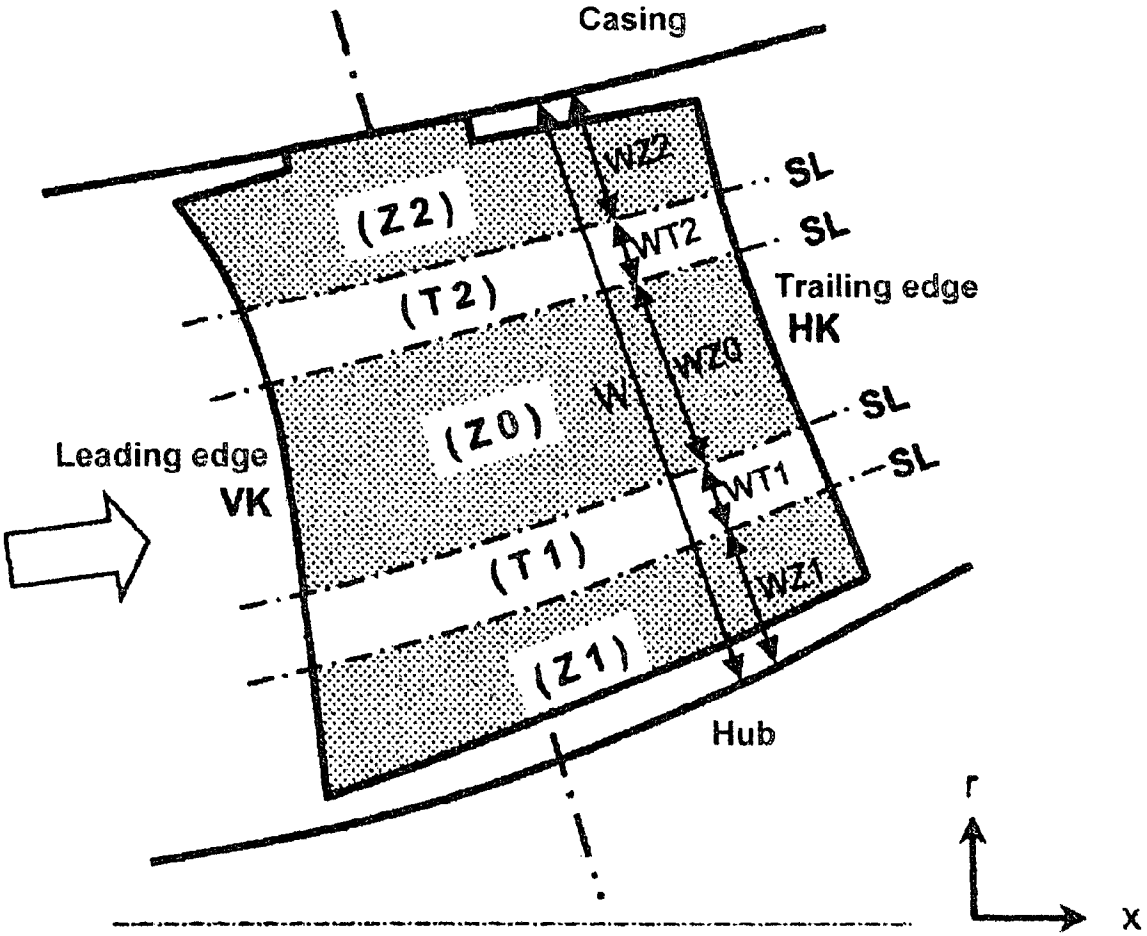
Fig. 3b: Variable stator (borne in casing) in accordance with the present invention
„SG“

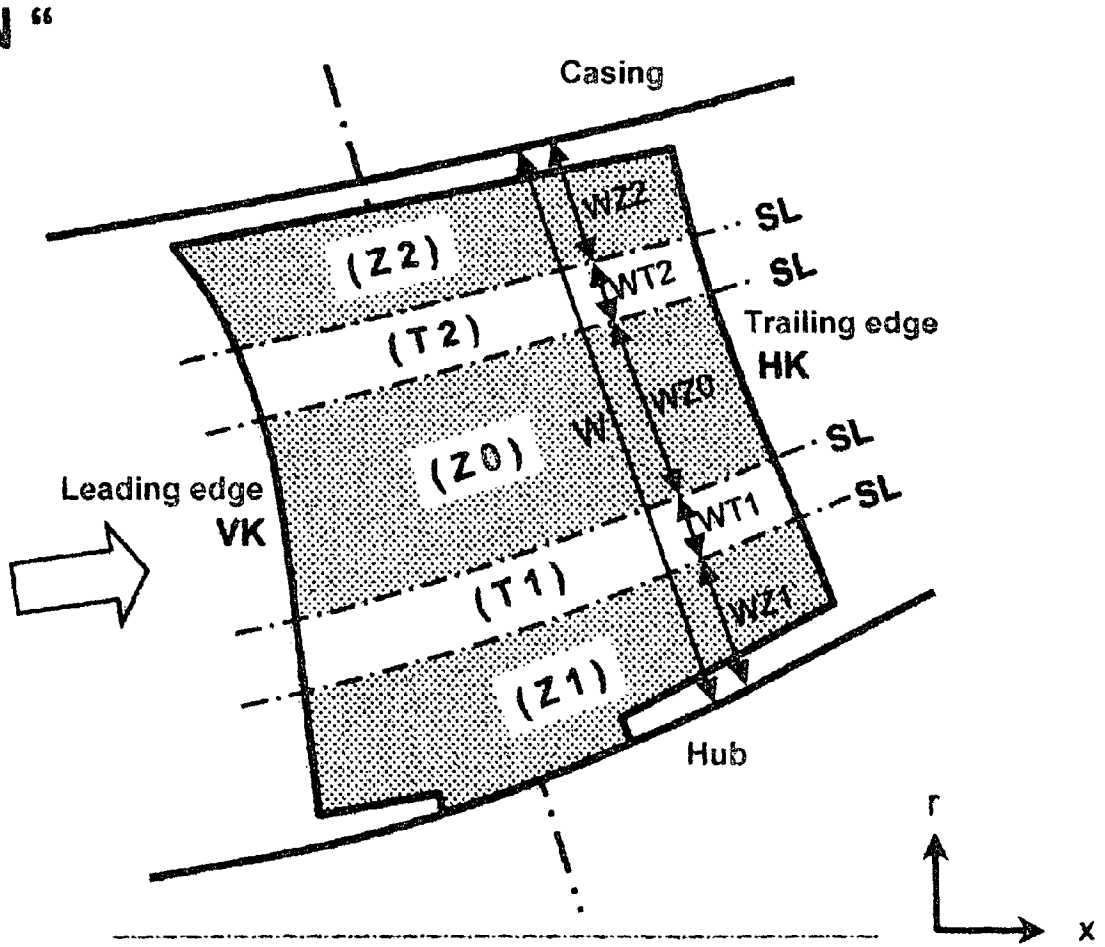
Fig. 3c: Variable stator (borne in hub) in accordance with the present invention
„SN"

Fig. 3d: Allocation of blade zones (Z1), (Z0), (Z2) and of defined types of skeleton lines PM and PR in accordance with the present invention

| Zone | Types of skeleton lines on blade | | |
|---|---|---|---|
| | SGN | SG | SN |
| (Z2) | PR | PR | optional |
| (Z0) | PM | PM | PM |
| (Z1) | PR | optional | PR |

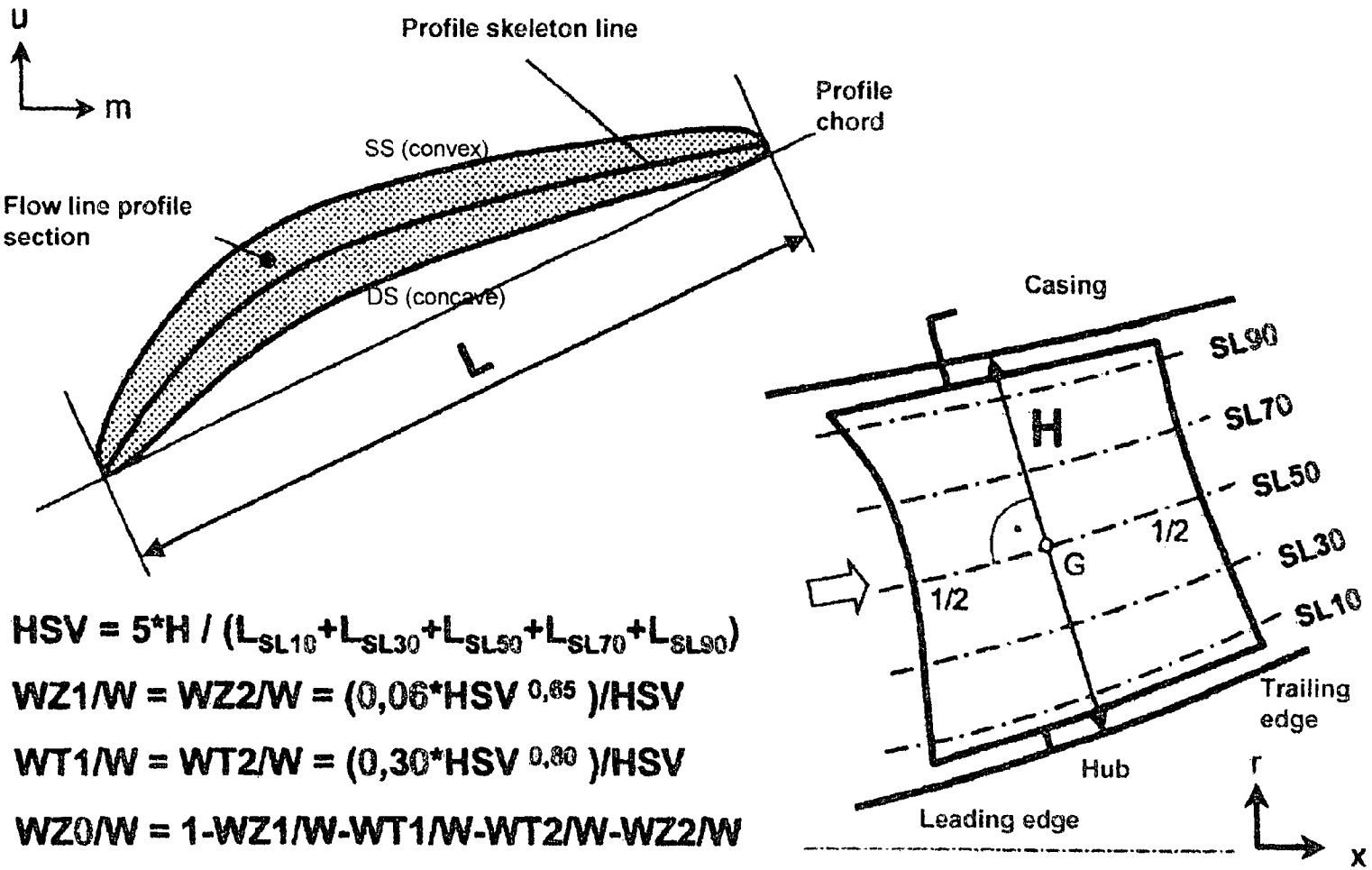
Fig. 4: Definition of height-to-side ratio HSV and of zone widths WZ1, WT1, WZ0, WT2, WZ2

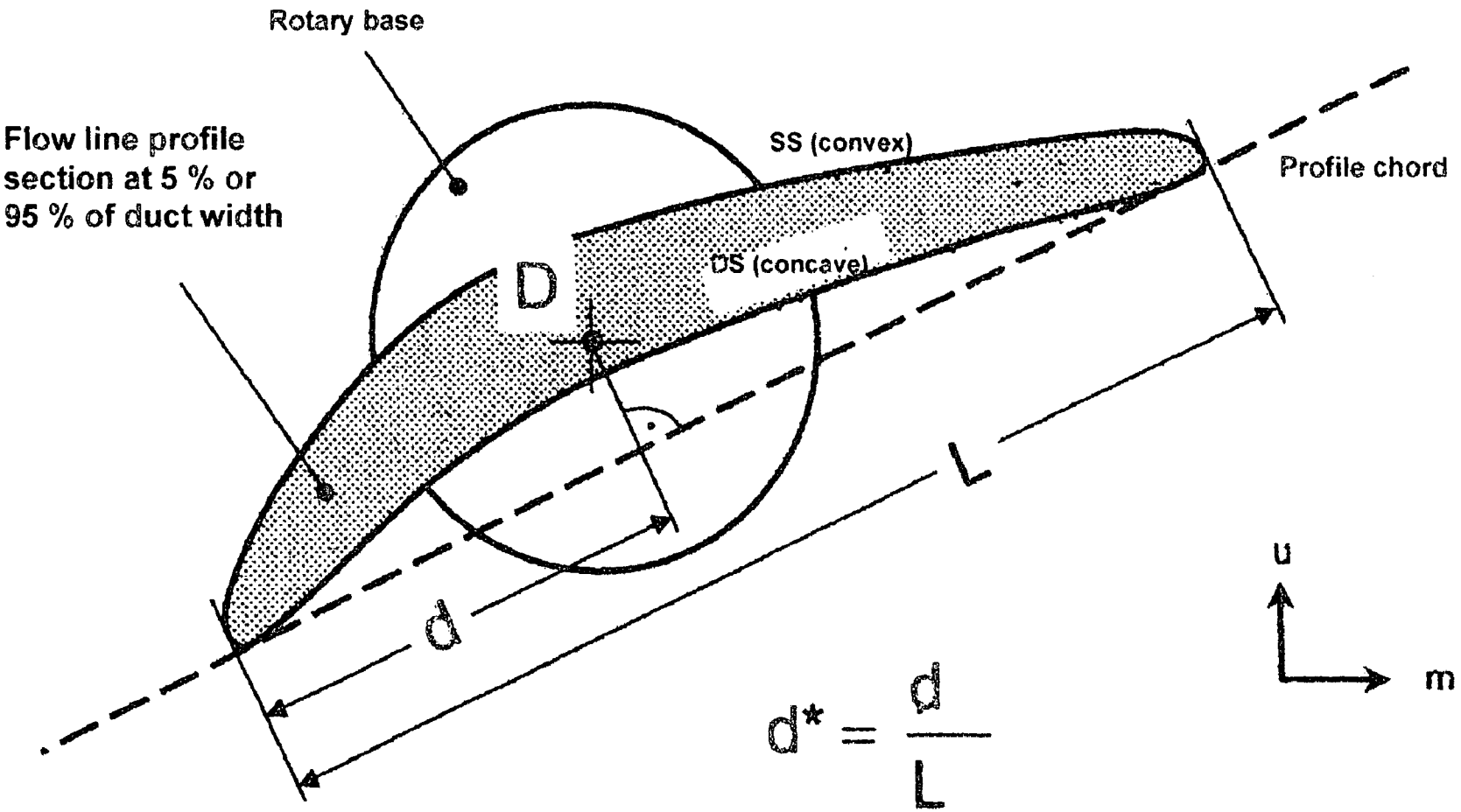
Fig. 5: Definition of rotating axis position on the blade ends

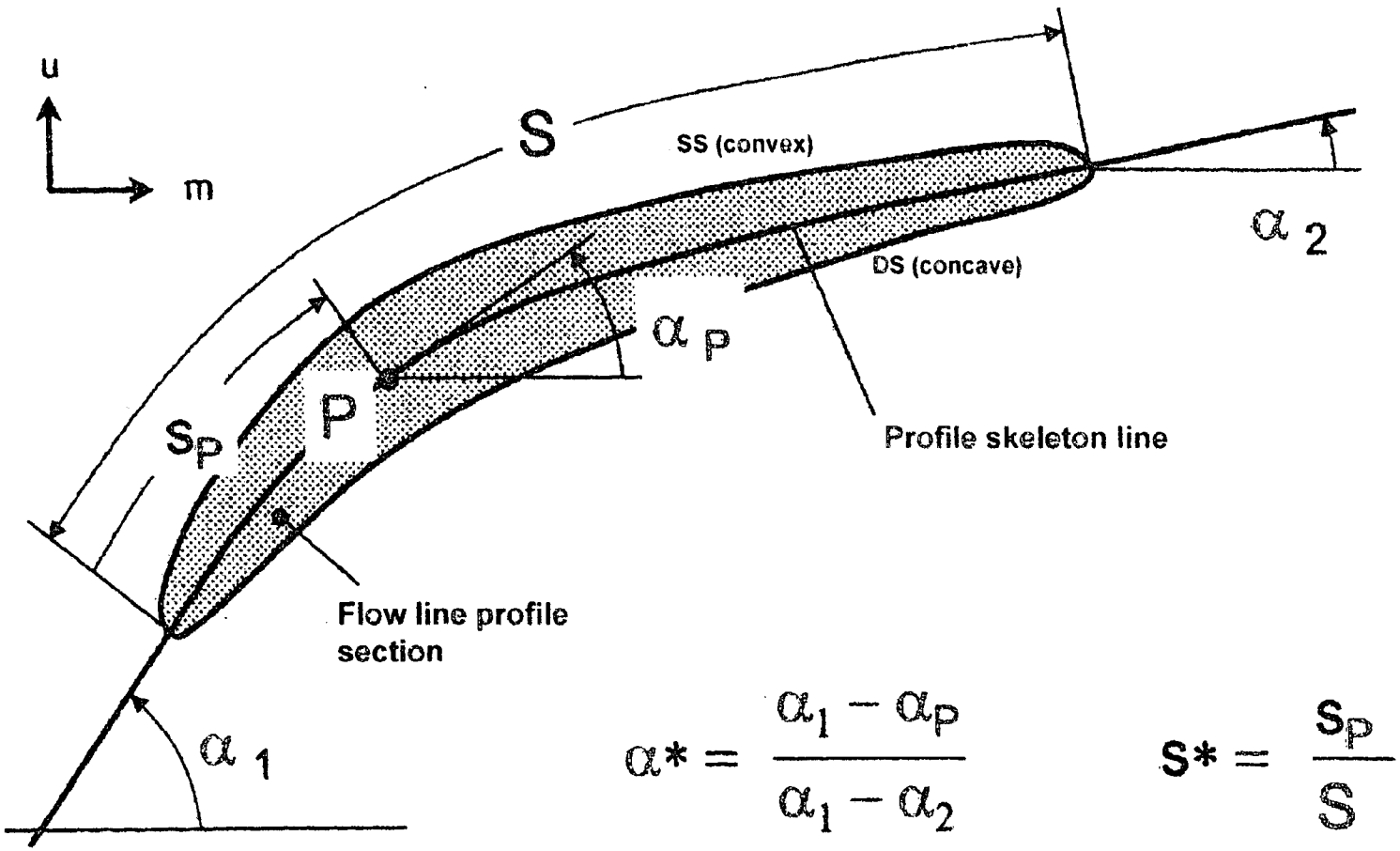
Fig. 6a: Definition of skeleton line of a flow line profile section

Fig. 6b: Definition of type "PM" of the profile skeleton line for the blade mid zone
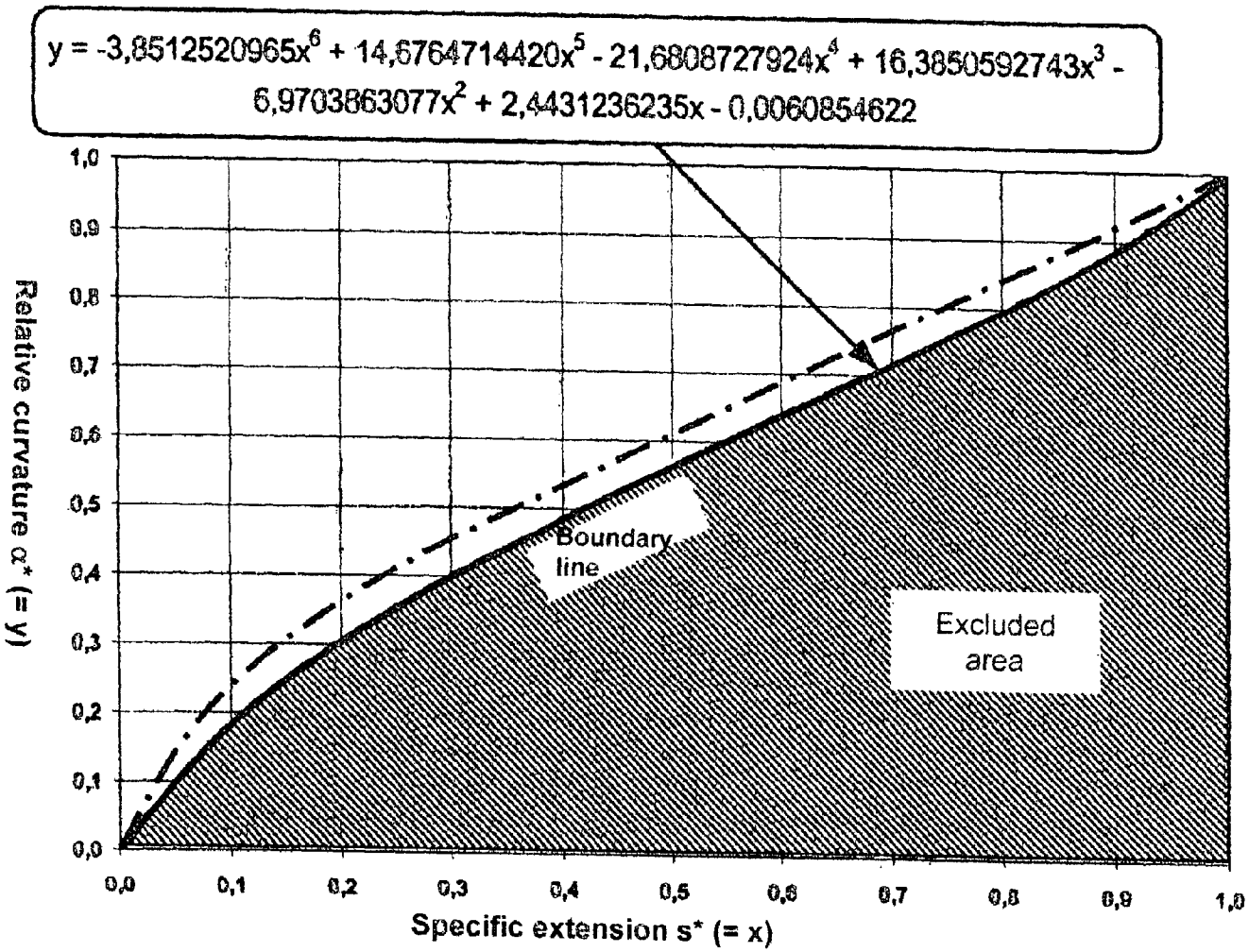

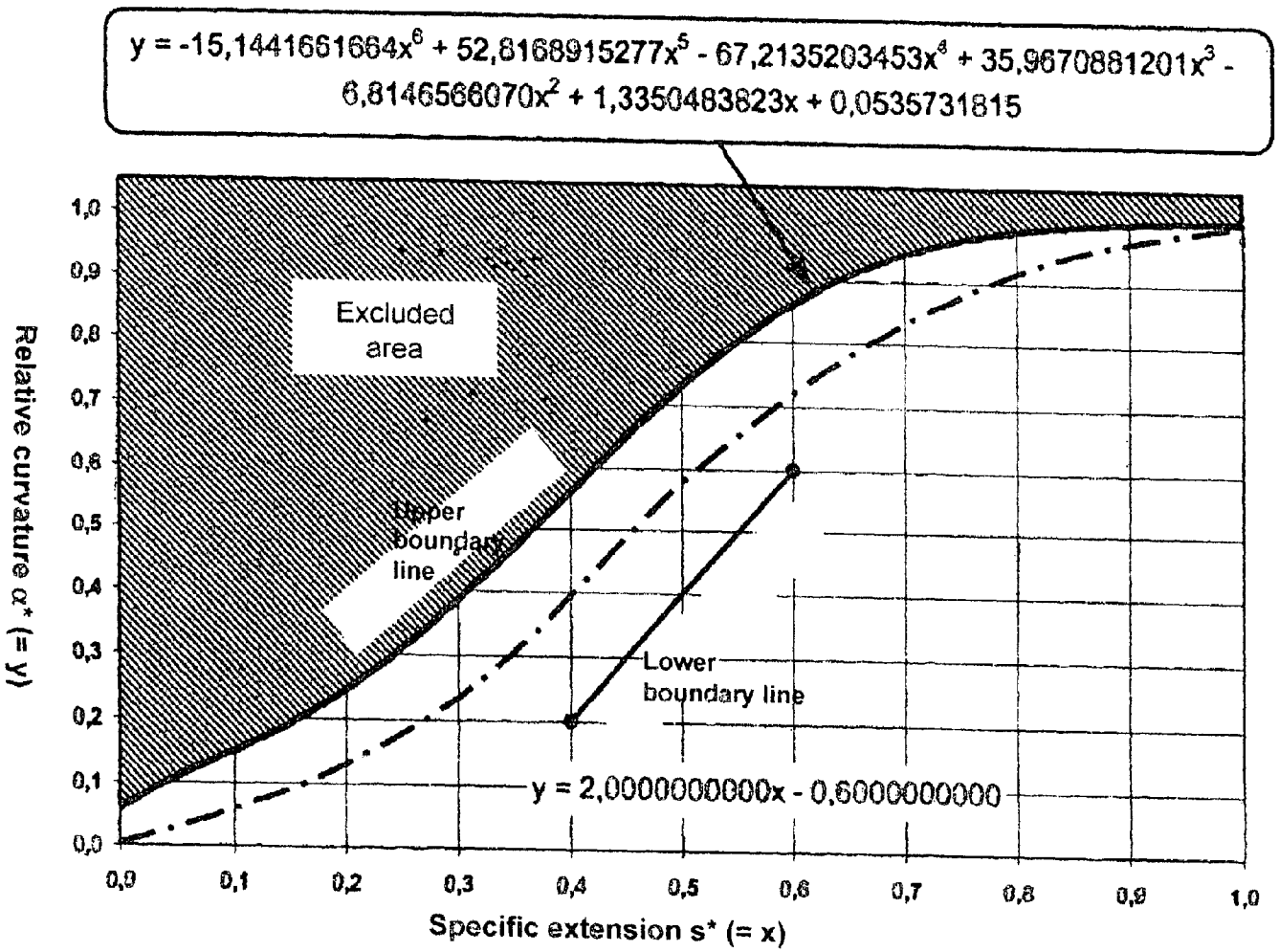
Fig. 6c: Definition of type "PR" of the profile skeleton line for the blade peripheral zone at a rotating axis position of d* = 0.30

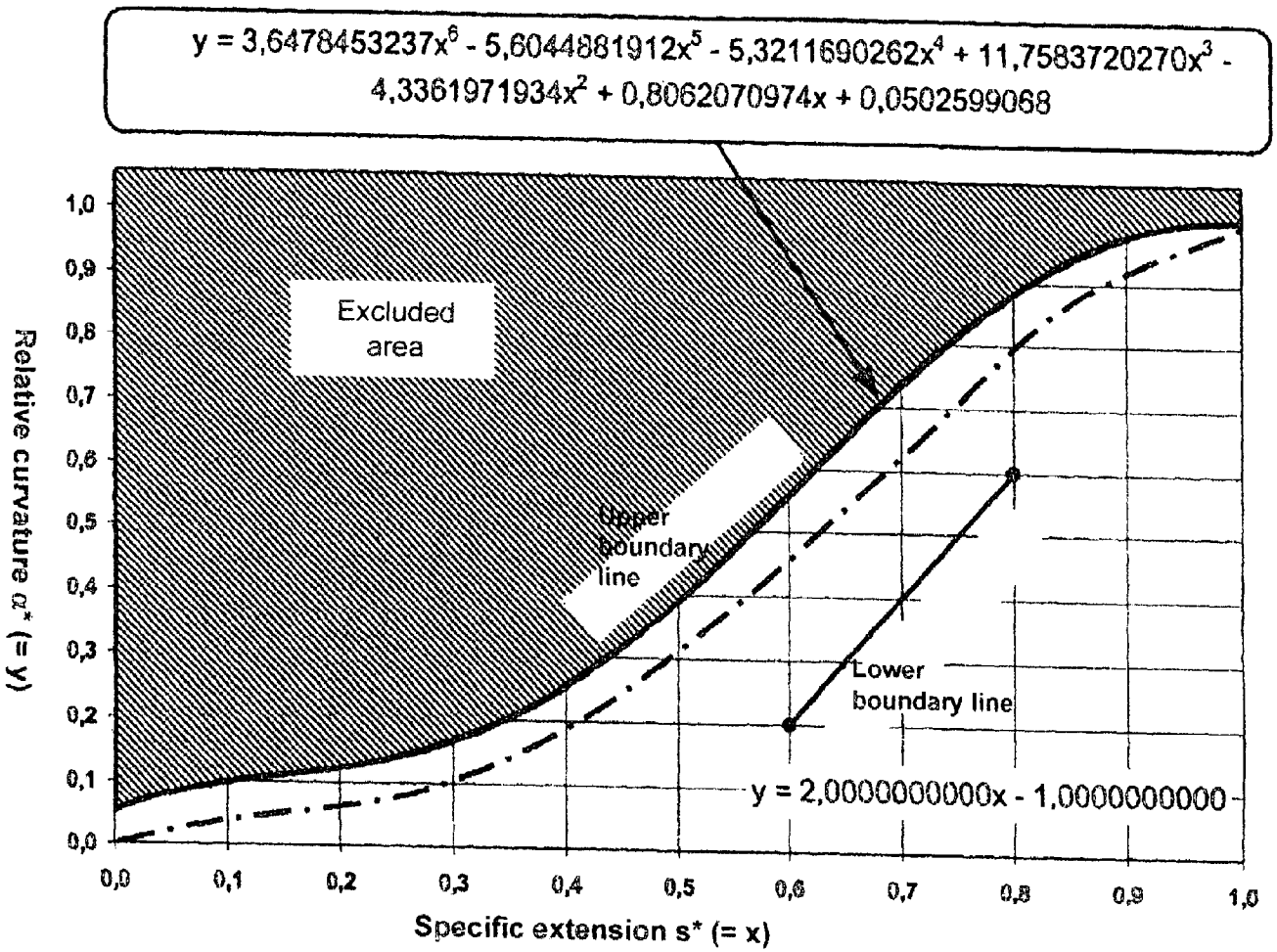
Fig. 6d: Definition of type "PR" of the profile skeleton line for the blade peripheral zone at a rotating axis position of d* = 0.50

TURBOMACHINE WITH VARIABLE STATOR

This application claims priority to German Patent Application DE 10 2005 060 699.7 filed Dec. 19, 2005, the entirety of which is incorporated by reference herein.

BACKGROUND OF THE INVENTION

The present invention relates to variable stator blades of turbomachines, such as blowers, compressors, pumps and fans of the axial, semi-axial or radial type. The working medium (fluid) may be gaseous or liquid.

More particularly, this invention relates to at least one variable stator blade of a turbomachine or to a variable inlet guide vane assembly, if applicable. The respective blading is situated within a casing, which confines the passage of fluid through at least one rotor and one stator in the outward direction. While a rotor comprises several rotor blades attached to a rotating shaft and transfers energy to the working medium, a stator consists of several stator blades mostly fixed in the casing.

The aerodynamic roadability and the efficiency of turbomachines, for example blowers, compressors, pumps and fans, is limited in particular by the growth and the separation of boundary layers in the area of the radial gaps between the blading and the casing or the hub, respectively, these gaps being necessary at the annulus rim for reasons of design.

In particular on rotatable variable stators, the radial gaps generated by the required recesses before and after the trunnion are pronounced and entail considerable flow losses. In order to limit these losses, rotary bases of max possible size are usually used on the inward and outward ends of the variable stators to keep small the extension of the recesses in flow direction. Preferably, the rotary bases are provided such that they are situated in the crucial profile leading edge zones of the blade peripheral sections.

However, due to failure provisions and design constraints, configurations of variable stators quite frequently exist which have only small size and where the rotary bases are not situated far enough upstream. In this case, a considerable radial gap exists both before and after the rotary base. The state of the art does not provide any aerodynamically favorable solutions to this fundamental problem. The general concept of boundary influencing of radial running gaps by changing the type of skeleton line along the blade height is provided in the state of the art, however, the known solutions are not adequate and, therefore, not effective, in particular for the flow conditions at a blade end with rotary base and two partial radial gaps.

FIG. 1 schematically shows two blade configurations in the meridional plane defined by the radial direction r and the axial direction x, these blade configurations corresponding to the state of the art. The representation is limited to a variable stator borne in the hub and the casing, a bearing only in the casing or the hub, with full radial gap at the respective (other) blade end is however also possible in individual cases.

On the left-hand side, a conventional variable stator without variation of the type of skeleton line is shown. In this simplest standard case, the blade consists of only one block (Z0) in which the type of the skeleton line is specified according to fixed rules. This category includes the so-called CDA (controlled diffusion airfoils) according to U.S. Pat. No. 4,431,376. Aerodynamically, CDA aim at a moderate profile front load.

On the right-hand side, a conventional blade is shown whose rotating base extends up to the leading edge. In lieu of a completely uniform profile, the blade may also feature a continuous change of the profile type over the entire height according to the state of the art. Here, the entire blade is not represented by a block (Z0) of uniform profile, but by only one large transition zone. This includes concepts from known publications providing for a transition from a CDA type of skeleton line to a type of skeleton line that aims more at a profile back load in the blade outer areas (R. F. Behike, Journal of Turbomachinery, Vol. 8, July 1986).

In addition, attempts exist to positively influence the peripheral zone flow by specially shaping the blade stacking axis, for example by imparting a bend, sweep or dihedral to the blading (see EP0661413A1, EP1106835A2, EP1106836A2). None of the existing solutions refers to variable stators.

DESCRIPTION OF THE INVENTION

The present invention relates to stators which are rotatably borne on at least one blade end and are variable around a fixed rotating axis by a trunnion. As in all representations shown herein, inflow to the respective blade row is from the left to the right in the direction of the bold arrow.

The state of the art is disadvantageous in that the respective blade forms are designed, often deliberately, with low complexity regarding the shape of the skeleton line. Where different types of skeleton lines along the blade height are used, the character of the skeleton lines lacks block-wise markedness which would allow the profile pressure distribution in wall vicinity to be stronger influenced to obtain the max. possible degree of gap and peripheral flow steadying. In particular with variable stators, there is a lack of blade concepts with skeleton line variations along the blade height which appropriately combine a profile front load favorable in the blade mid area with a type of load distribution favorable for the peripheral areas.

A broad aspect of the present invention is to provide a variable stator blade of the type specified above which, while avoiding the disadvantages of the state of the art, is characterized by exerting a highly effective influence on the peripheral flow due to a specific and problem-oriented block-wise definition of the profile skeleton lines along the blade height.

It is a particular object of the present invention to provide solutions to the above problems by a combination of the features described herein. Further advantageous embodiments of the present invention will become apparent from the description below.

The present invention provides for a variable stator blade for use in a turbomachine which features defined types of profile skeleton lines in different zones (blocks) of the blade height, limited by meridional flow lines, with the proviso that i) the distribution of the types of skeleton lines along the blade height advantageously combines a marked aerodynamic profile front load in the blade mid area with a specific profile load distribution in the peripheral areas, ii) a specifically delimited type of skeleton line is provided throughout the defined peripheral zones Z1 and Z2, in accordance with the definition given further below, iii) the choice of the type of skeleton line in the transition zones T1 and T2 following Z1 and Z2 towards the blade center is optional, iv) a specifically delimited type of skeleton line according to the definition given further below is provided throughout the defined blade mid zone Z0.

The present invention is more fully described in light of the accompanying drawings showing examples of embodiments. In the drawings, FIG. 1 is a schematic representation of variable stators according to the state of the art, FIG. 2 shows the definition of meridional flow lines and flow line profile sections, FIG. 3*a* shows a variable stator (borne in casing and hub) "SGN" according to the present invention, FIG. 3*b* shows a variable stator (borne in casing) "SG" according to the present invention, FIG. 3*c* shows a variable stator (borne in hub) "SN" according to the present invention, FIG. 3*d* provides the allocation of the blade zones Z1, Z0, Z2 according to the present invention and of the defined types of skeleton lines PM and PR, FIG. 4 provides the definition of the height-to-side ratio HSV and of the individual zone widths (block widths) WZ1, WT1, WZ0, WT2, WZ2, FIG. 5 provides the definition of the rotating axis position at the blade ends, FIG. 6*a* provides the definition of the skeleton line of a flow line profile section, FIG. 6*b* provides the definition of the type of profile skeleton line "PM" for the blade mid zone, FIG. 6*c* provides the definition of the type of profile skeleton line "PR" for the blade peripheral zone at a rotating axis position of D=0.3, FIG. 6*d* provides the definition of the type of profile skeleton line "PR" for the blade peripheral zone at a rotating axis position of D=0.5.

FIG. 2 provides a precise definition of the meridional flow lines and the flow line profile sections. The central meridional flow line is established by the geometrical center of the annulus. If a normal is erected at any point on the central flow line, the annulus width W along the flow path and a number of normals are obtained, these enabling further meridional flow lines to be produced, with same relative division in the direction of the duct height. The intersection of a meridional flow line with a blade produces a flow line profile section.

FIG. 3*a* shows the variable stator blade borne in casing and hub "SGN" according to the present invention in the meridional plane defined by the axial coordinate x and the radial coordinate r. Here, the blade peripheral zones Z1 and Z2, the transition zones T1 and T2 and the blade mid zone Z0 are highlighted and limited by the respective meridional flow lines according to the definition in FIG. 2. A partial width WZ1, WT1, WZ0, WT2, WZ2 is allocated to each of the five blade zones which is measured in the direction of the duct width W.

Analogically with this representation, FIG. 3*b* and FIG. 3*c* show the inventive stator blade borne in casing "SG" as well as the inventive stator blade borne in hub "SN".

FIG. 3*d* shows in tabulated form the allocation according to the present invention of the three blade zones Z1, Z0, Z2 and of the types of skeleton lines PM and PR specified below (FIGS. 6*b*-*d*). For example, type PR is provided in zone Z1, type PM in zone Z0 and type PR in zone Z2 for the blade configuration "SGN". Zone Z1 in the case of blade configuration "SG" and zone Z2 in the case of blade configuration "SN" are optional, as no rotary base exists at the respective blade end.

PM—Type of profile skeleton line for the blade mid zone,

PR—Type of profile skeleton line for the blade peripheral zone.

FIG. 4 shows the definition of the height-to-side ratio relevant for the determination of the respective zone width. The bottom right-hand half of the figure contains a sketch of a blade configuration with a number of meridional flow lines. Firstly, the central flow line, with the distance between the leading and the trailing edge being halved, defines the position for establishing the total blade height H (point G). Height H is established along a straight line normal to the central flow line in point G. Furthermore, five flow lines are defined at 10%, 30%, 50%, 70% and 90% of the duct width W (SL10, SL30, SL50, SL70, SL90) along which the respective chord length L is to be determined. The definition of L for any meridional flow surface (u-m plane) is shown in the upper left-hand half of the figure. The chord length resulting at xy% of the duct width is designated with LSLxy here and in the formulas of FIG. 4. The height-to-side ratio is finally to be determined a follows:

$$HSV=5\cdot H/(L_{SL10}+L_{SL30}+L_{SL50}+L_{SL70}+L_{SL90})$$

The zone widths are determined in dependence of the height-to-side ratio in relative form (related to the total duct width W) according to the following rule:

$$WZ1/W=WZ2/W=(0.06\cdot HSV^{0.65})/HSV$$

$$WT1/W=WT2/W=(0.30\cdot HSV^{0.80})/HSV$$

$$WZ0/W=1-WZ1/W-WT1/W-WZT2/W-WZ2/W$$

FIG. 5 shows the definition of the rotating axis position which is co-determinant for the type PR of the profile skeleton line to be provided according to the present invention. The Figure schematically shows the flow line section through the variable stator blade at 5 percent or 95 percent duct width, respectively. Shown is the break-through point of the rotating axis in the plane of the flow line section, point D. This point need not necessarily lie within the profile, as shown here. The overall profile chord length is L. By dropping the perpendicular of point D on the profile chord, the distance d of the rotating axis from the leading edge measured in the same direction is obtained. The relative position of the rotating axis in the direction of the profile chord is designated d*=d/L.

The respective type of skeleton line is defined in relative representation by way of the specific angle of inclination $\alpha^*$ and the specific extension s*, ref. FIG. 6*a*. The figure shows a flow line profile section of the blade on a meridional flow area (u-m plane).

For this, the angle of inclination $\alpha_p$ and the extension $s_p$ covered so far are determined in all points of the skeleton line. For reference, the inclination angle at the leading and the trailing edge $\alpha 1$ and $\alpha 2$ and the skeleton-line total extension S are used. The following applies:

$$\alpha^*=(\alpha_1-\alpha_p)/(\alpha_1-\alpha_2) \text{ and } s^*=s_p/S.$$

FIG. 6*b* shows the definition of the type "PM" of the skeleton line in the known relative representation. Skeleton line extensions according to the present invention are above the boundary line. Skeleton line extensions in the excluded area below and on the boundary line do not comply with the present invention. The boundary line for the type "PM" of the skeleton line is given by the following definition:

$$\alpha^*=-3.8512520965(s^*)^6+14.6764714420(s^*)^5-21.6808727924(s^*)^4+16.3850592743(s^*)^3-6.9703863077(s^*)^2+2.4431236235(s^*)-0.0060854622$$

A skeleton line distribution provided according to the present invention for the block at the blade center is delineated by way of example.

FIGS. 6*c* and 6*d* show the definition of the type "PR" of the skeleton line in the known relative representation for the rotating axis positions d*=0.3 and d*=0.5. Skeleton line extensions according to the present invention are below the continuous upper boundary line and above the lower boundary line given at a certain interval. Skeleton line extensions in the excluded area above and on the upper boundary line do not comply with the present invention. Skeleton line extensions below or on the lower boundary line do not comply with the present invention either.

Depending on the relative rotating axis positions d* the boundary lines for the type "PR" of the skeleton line are given by the following definitions:

Upper boundary line for d*=0.3:

$$\alpha^*=-15.1441661664(s^*)^6+52.8168915277(s^*)^5-67.2135203453(s^*)^4+35.9670881201(s^*)^3-6.8146566070(s^*)^2+1.3350483823(s^*)+0.0535731815$$

Upper boundary line for d*=0.5:

$$\alpha^*=3.6478453237(s^*)^6-5.6044881912(s^*)^5-5.3211690262(s^*)^4+11.7583720270(s^*)^3-4.3361971934(s^*)^2+0.8062070974(s^*)+0.0502599068$$

For rotating axis positions d* unequal to 0.3 and 0.5, the values of α* are to be determined by linear interpolation between those for d*=0.3 and d*=0.5.

$$\alpha^*(d^*)=\alpha^*(d^*=0.5)+[\alpha^*(d^*=0.3)-\alpha^*(d^*=0.5)]^*[0.5-d^*]/0.2$$

Lower boundary:

$$\alpha^*=2.0(s^*)-2d^*$$

Applicable at the interval of s*: (d*+0.1; d*+0.3)

In FIGS. 6*c* and 6*d* one each skeleton line distribution provided according to the present invention for the blade peripheral block is delineated by way of example.

With the blade for turbomachines, such as blowers, compressors, pumps and fans, according to the present invention, peripheral flow influencing is achieved which is capable of increasing the efficiency of each stage by approx. 1 percent, with stability remaining unchanged. In addition, a reduction of the number of blades of up to 20 percent is possible. The concept according to the present invention is applicable to different types of turbomachines and, depending on the degree of utilization of the concept, yields savings in cost and weight of the turbomachine of 2 to 10 percent. In addition, the overall efficiency of the turbomachine is increased by up to 1.5 percent, depending on the application.

What is claimed is:

1. A variable stator of a turbomachine with a profile skeleton line extending along a meridional flow line, the stator being radially divided into at least a mid zone and two peripheral zones with a profile skeleton line for the blade mid zone remaining above a limiting line given by the following equation:

$$\alpha^*=-3.8512520965(s^*)^6+14.6764714420(s^*)^5-21.6808727924(s^*)^4+16.3850592743(s^*)^3-6.9703863077(s^*)^2+2.4431236235(s^*)-0.0060854622$$

where:

$$\alpha^* = \frac{\alpha_1 - \alpha_P}{\alpha_1 - \alpha_2}$$

$$S^* = \frac{S_P}{S}$$

and

P is any point of the profile skeleton line, $\alpha_1$ is an angle of inclination at a stator leading edge, $\alpha_2$ is an angle of inclination at a stator trailing edge, α* is a dimensionless, specific angle of a total curvature, S* is a dimensionless, specific extension, $\alpha_P$ is an angle of a tangent at any point P of the profile skeleton line to the central meridional flow line, $s_P$ is an extension of the profile skeleton line at any point P, and S is a total extension of the profile skeleton line.

2. A variable stator in accordance with claim 1, with a height-to-side ratio (HSV) being determined by the following equation:

$$HSV=5\cdot H/(L_{SL10}+L_{SL30}+L_{SL50}+L_{SL70}+L_{SL90}),$$

where

H is a height along a straight line normal to a central flow line and intersecting a point G on the central flow line midway between a leading edge and a trailing edge of the stator, L is a length of the profile chord, and the individual lengths L of the profile chords for five flow lines are at 10%, 30%, 50%, 70% and 90% of a width W of the flow duct:

and;

zone widths are determined in dependence of the height-to-side ratio (HSV) in relative form, related to the duct width (W) according to the following equations:

$$WZ1/W=WZ2/W=(0.06\cdot HSV^{0.65})/HSV$$

$$WT1/W=WT2/W=(0.30\cdot HSV^{0.80})/HSV$$

$$WZ0/W=1-WZ1/W-WT1/W-WZT2/W-WZ2/W,$$

where

W is a duct width,

WZ1 is a duct width in a zone 1,

WZ2 is a duct width in a zone 2,

WZ0 is a duct width in a central zone

WT1 is a duct width in a transition zone between zone Z1 and zone Z0, and WT2 is a duct width in a transition zone between zone Z0 and zone Z2.

3. A variable stator of a turbomachine with a profile skeleton line extending along a meridional flow line, the stator being radially divided into at least a mid zone and two peripheral zones with a profile skeleton line for at least one of the peripheral zones remaining below a limiting line given by the following equations:

$$\alpha^*=-15.1441661664(s^*)^6+52.8168915277(s^*)^5-67.2135203453(s^*)^4+35.9670881201(s^*)^3-6.8146566070(s^*)^2+1.3350483823(s^*)+0.0535731815$$

for a relative rotating axis position d*=0.3;

$$\alpha^*=3.6478453237(s^*)^6-5.6044881912(s^*)^5-5.3211690262(s^*)^4+11.7583720270(s^*)^3-4.3361971934(s^*)^2+0.8062070974(s^*)+0.0502599068$$

for a relative rotating axis position d*=0.5; and $$\alpha^*(d^*)=\alpha^*(d^*=0.5)+[\alpha^*(d^*=0.3)-\alpha^*(d^*=0.5)]^*[0.5-d^*]/0.2$$

for a relative rotating axis position d* unequal to 0.3 and 0.5;

where:

$$\alpha^* = \frac{\alpha_1 - \alpha_P}{\alpha_1 - \alpha_2}$$

-continued $$S^* = \frac{S_P}{S}$$

and

P is any point of the profile skeleton line, $\alpha_1$ is an angle of inclination at a stator leading edge, $\alpha_2$ is an angle of inclination at a stator trailing edge, $\alpha^*$ is a dimensionless, specific angle of a total curvature, S* is a dimensionless, specific extension, $\alpha_P$ is an angle of a tangent at any point P of the profile skeleton line to the central meridional flow line, $s_P$ is an extension of the profile skeleton line at any point P, and S is a total extension of the profile skeleton line.

4. A variable stator in accordance with claim 3, with a height-to-side ratio (HSV) being determined by the following equation:

$$HSV=5\cdot H/(L_{SL10}+L_{SL30}+L_{SL50}+L_{SL70}+L_{SL90}),$$

where

H is a height along a straight line normal to a central flow line and intersecting a point G on the central flow line midway between a leading edge and a trailing edge of the stator, L is a length of the profile chord, and the individual lengths L of the profile chords for five flow lines are at 10%, 30%, 50%, 70% and 90% of a width W of the flow duct;

and;

zone widths are determined in dependence of the height-to-side ratio (HSV) in relative form, related to the duct width (W) according to the following equations:

$$WZ1/W=WZ2/W=(0.06\cdot HSV^{0.65})/HSV$$

$$WT1/W=WT2/W=(0.30\cdot HSV^{0.80})/HSV$$

$$WZ0/W=1-WZ1/W-WT1/W-WZT2/W-WZ2/W,$$

where

W is a duct width,

WZ1 is a duct width in a zone 1,

WZ2 is a duct width in a zone 2,

WZ0 is a duct width in a central zone

WT1 is a duct width in a transition zone between zone Z1 and zone Z0, and WT2 is a duct width in a transition zone between zone Z0 and zone Z2.

5. A variable stator in accordance with claim 4, with a profile skeleton line for the blade mid zone remaining above a limiting line given by the following equation:

$$\alpha^*=-3.8512520965(s^*)^6+14.6764714420(s^*)^5-21.6808727924(s^*)^4+16.3850592743(s^*)^3-6.9703863077(s^*)^2+2.4431236235(s^*)-0.0060854622.$$

6. A variable stator in accordance with claim 5, with the profile skeleton line for the at least one of the peripheral zones remaining above a limiting line given by the following equation:

$$\alpha^*=2.0(s^*)-2d^*.$$

7. A variable stator in accordance with claim 4, with the profile skeleton line for the at least one of the peripheral zones remaining above a limiting line given by the following equation:

$$\alpha^*=2.0(s^*)-2d^*.$$

8. A variable stator in accordance with claim 3, with a profile skeleton line for the blade mid zone remaining above a limiting line given by the following equation:

$$\alpha^*=-3.8512520965(s^*)^6+14.6764714420(s^*)^5-21.6808727924(s^*)^4+16.3850592743(s^*)^3-6.9703863077(s^*)^2+2.4431236235(s^*)-0.0060854622.$$

9. A variable stator in accordance with claim 8, with the profile skeleton line for the at least one of the peripheral zones remaining above a limiting line given by the following equation:

$$\alpha^*=2.0(s^*)-2d^*.$$

10. A variable stator in accordance with claim 3, with the profile skeleton line for the at least one of the peripheral zones remaining above a limiting line given by the following equation:

$$\alpha^*=2.0(s^*)-2d^*.$$

* * * * *